US006192969B1

(12) United States Patent
Bunn et al.

(10) Patent No.: US 6,192,969 B1
(45) Date of Patent: Feb. 27, 2001

(54) CASTING OF HIGH PURITY OXYGEN FREE COPPER

(75) Inventors: Bradley D. Bunn, Arvada; Jeffrey Burton, Thronton; Margaret W. Staub, Evergreen, all of CO (US)

(73) Assignee: ASARCO Incorporated, New York, NY (US)

( * ) Notice: Subject to any disclaimer, the term of this patent is extended or adjusted under 35 U.S.C. 154(b) by 0 days.

(21) Appl. No.: 09/273,997

(22) Filed: Mar. 22, 1999

(51) Int. Cl.[7] ..... B22D 27/04

(52) U.S. Cl. ..... 164/122.1; 164/122.2; 164/66.1; 164/338.1; 164/259

(58) Field of Search ..... 164/122.1, 122.2, 164/66.1, 67.1, 68.1, 338.1, 259

(56) References Cited

U.S. PATENT DOCUMENTS

| | | | | |
|---|---|---|---|---|
| 3,900,695 | | 8/1975 | Andersson et al. | 13/26 |
| 3,937,268 | * | 2/1976 | Loebs et al. | 164/66.1 |
| 4,239,078 | | 12/1980 | Tarmann | 164/147 |
| 4,736,789 | | 4/1988 | Shinopulos et al. | 164/416 |
| 4,873,698 | | 10/1989 | Boen | 373/156 |
| 5,090,022 | | 2/1992 | Mortimer | 373/156 |
| 5,116,456 | * | 5/1992 | Nestor | 164/122.1 |
| 5,280,496 | | 1/1994 | Schlecht et al. | 373/158 |
| 5,701,993 | | 12/1997 | Whitlow et al. | 200/264 |

FOREIGN PATENT DOCUMENTS

| | | | | |
|---|---|---|---|---|
| 603738A1 | * | 6/1994 | (EP) | 164/122.1 |
| 43-22281 | * | 9/1968 | (JP) | 164/67.1 |
| 53-12726 | * | 2/1978 | (JP) | 164/66.1 |
| 58-50172 | * | 3/1983 | (JP) | 164/66.1 |

* cited by examiner

*Primary Examiner*—Harold Pyon
*Assistant Examiner*—I.-H. Lin
(74) *Attorney, Agent, or Firm*—DeLio & Peterson, LLC

(57) ABSTRACT

A method and apparatus are provided for making high purity and preferably oxygen free substantially void free and inclusion free copper castings such as billets from high purity copper. The castings are particularly useful to make sputtering targets used in sputtering deposition processes in the fabrication of electronic components. The method comprises melting high purity copper in a covered crucible using a non-contaminating heating source such as a coil induction furnace. The melted copper in the crucible is solidified using a specially controlled cooling procedure wherein the bottom of the crucible is cooled so that molten copper is maintained on top of solidified and solidifying copper until the copper is solidified. In a preferred apparatus and method, the furnace and crucible, which is disposed between the coil of the furnace and contains molten copper, are positioned above a cooling jacket and the crucible passed continuously downwardly through the opening in the cooling jacket cooling the lower portion of the crucible. A reduced heat is maintained in the furnace to heat the upper portion of the crucible within the coil and maintain a layer of molten copper over the copper solidifying in the lower portion of the crucible passing through the water jacket. A reducing gas is supplied to the covered crucible and the crucible is insulated during the method.

13 Claims, 4 Drawing Sheets

CASTING OF HIGH PURITY OXYGEN FREE COPPER

BACKGROUND OF THE INVENTION

1. Field of the Invention

This invention relates to a method for making high purity copper castings such as billets from high purity copper, and, in particular, to high purity oxygen free copper billets which are substantially void free and inclusion free and which are suitable in the fabrication of microelectronics and other electronic components to make sputter targets for depositing a layer of copper onto component surfaces by a sputter deposition process.

2. Description of Related Art

Copper is a very important industrial metal and is used for many applications ranging from electrical wiring to roofing to the fabrication of household and industrial articles. Copper because of its high electrical conductivity is particularly useful for electrical wiring to form circuitry in the fabrication of electronic components including microelectronics and semiconductors.

In the electronics industry and, in particular, the microelectronics industry, it is important that the copper be of high purity and oxygen free because of the need for maximum electrical conductivity and other electrical and fabrication properties. It is also important that the copper be available in a commercial form in which the manufacturers of electronic components can easily and efficiently use the copper to fabricate the electronic products. In one particular application, copper is supplied to the manufacturers in the form of billets about 6 inch in diameter by 10 inch high which billets are formed by them into 2 inch thick disks. These disks are then used in a sputtering deposition process to form a layer of copper on an electronic component substrate such as a wafer or dielectric surface.

In general, a copper billet is used in the fabrication of microelectronic components by cutting the billet into disks which are used as sputter targets in a sputter deposition system. Sputtering is a process whereby the sputter target (copper) is bombarded in a vacuum chamber with positive ions forming copper atoms. The copper atoms are then deposited on the surface of a substrate which is also positioned within the vacuum chamber. An even copper layer is important to the deposition process and if the disk copper sputter target has significant voids or inclusions, arcing may result causing an uneven deposit on the substrate surface.

Bearing in mind the problems and deficiencies of the prior art, it is therefore an object of the present invention to provide a method for making high purity and preferably oxygen free copper castings including billets from high purity copper.

It is another object of the present invention to provide a method for making high purity and preferably oxygen free copper castings from high purity copper wherein the castings are substantially void free and inclusion free and which oxygen free castings are suitable for use as sputter targets in sputter deposition processes used to make electronic components.

It is yet another object of the present invention to provide an apparatus for making high purity copper and preferably oxygen free castings from high purity copper.

Another object of the present invention is to provide an apparatus for making high purity copper and preferably oxygen free castings from high purity copper wherein the castings are substantially void free and inclusion free and which castings are suitable for use as sputter targets in sputter deposition processes used to make electronic components.

A further object of the invention is to provide high purity and preferably oxygen free copper castings, particularly castings which are substantially void free and inclusion free, made by the method and/or apparatus of the invention.

Still other objects and advantages of the invention will in part be obvious and will in part be apparent from the specification.

SUMMARY OF THE INVENTION

The above and other objects, which will be apparent to one of skill in the art, are achieved in the present invention which relates in one aspect to a method for making high purity preferably oxygen free copper castings such as billets from high purity copper, and, in particular, billets which are substantially void free and inclusion free, comprising the steps of:

- providing an open top container having a closed bottom and sidewalls for melting and/or holding molten copper therein;
- supplying high purity copper to the container;
- melting the copper if necessary and forming molten copper in the container;
- preferably covering the open end of the container and/or maintaining the surface of the molten copper under an inert or reducing atmosphere; and
- cooling the container to solidify the copper therein under cooling conditions wherein the container is cooled from the bottom upwards toward the top of the container so that both solidified copper and molten copper are present in the container at the same time with the copper solidifying from the bottom of the container upwards and continuing to solidify on top of the solidified copper so that a layer of molten copper is maintained on top of the solidified and solidifying copper until the copper is solidified and a casting is formed.

In another aspect of the invention a method is provided for making high purity copper preferably oxygen free castings from high purity copper which castings are substantially void free and inclusion free comprising the steps of:

- providing an open top container having a closed bottom and sidewalls for melting and holding copper therein;
- supplying high purity copper to the container;
- melting the copper in the container using a coil induction furnace wherein the coil forms a vertical opening therebetween in which the container is positioned and forming molten copper in the container by energizing the furnace with an electric current;
- preferably covering the open end of the container and/or maintaining the surface of the molten copper under an inert or reducing atmosphere;
- providing a cooler having cooled sidewalls and a vertical opening therebetween, the cooler being configured to accommodate and receive the container in the vertical opening in a heat transfer relationship so that heat is transferred from the container to the cooler;
- positioning the bottom of the container at the top of the cooler opening and passing the container downwardly through the cooler opening at a controlled downward rate and/or a controlled cooler sidewall cooling rate wherein both solidified copper and molten copper are present in the container at the same time with the copper solidifying from the bottom of the container upwards toward the top of the container and continuing to solidify on top of the solidified copper so that a layer of molten copper is maintained on top of the solidified and solidifying copper until the copper is solidified and a casting is formed.

In a further aspect of the invention an apparatus is provided for making high purity preferably oxygen free copper castings from high purity copper which castings are substantially void free and inclusion free comprising:

an open top container having a closed bottom and sidewalls for melting and holding molten copper therein;

means for supplying high purity copper to the container;

means for melting the copper if necessary and forming molten copper in the container;

optional means for covering the open end of the container and/or maintaining copper under an inert or reducing atmosphere in the container;

means for cooling the container under cooling conditions wherein the container is cooled from the bottom upwards toward the top of the container so that both solidified copper and molten copper are present in the container at the same time with the copper solidifying from the bottom of the container upwards and continuing to solidify on top of the solidified copper so that a layer of molten copper is maintained on top of the solidified and solidifying copper until the copper is solidified and a casting is formed.

In another aspect of the invention, the container for melting copper therein is a cylindrical hollow crucible having a closed bottom, open top and circumferential sidewall and made of graphite or similar refractory material. A preferred melting means is a coil induction furnace wherein the crucible is placed within an opening formed between the induction coil and a current is supplied to the induction furnace for melting the copper. The induction furnace coil is preferably tubular (or having a through opening therein) for circulating a coolant such as water therethrough for controlling the coil temperature during use of the furnace. After the copper is melted, the crucible is cooled as described hereinabove to provide the substantially void free and inclusion free casting.

In an additional aspect of the invention, the induction furnace and crucible held within the coil opening are positioned over the cooling means so that when the copper is melted, the crucible is lowered through the induction furnace coil through the opening in the cooling means providing the desired container upward cooling profile. It is preferred to maintain a current or a heat input to the furnace, typically lower than the copper melting step, to maintain the upper portion of the crucible not yet being cooled and molten copper thereat at a higher temperature than the lower part of the crucible which is passing downward through the cooler and is being cooled from the bottom upwards with the copper being solidified from the bottom of the container upwardly.

In another aspect of the invention, using an induction coil furnace or similar type furnace, the container sidewall, bottom and top are insulated during the melting step and the insulation maintained during the cooling step on the portion of the sidewall not being cooled in the cooling means during the cooling step.

In a further aspect of the invention, high purity preferably oxygen free copper castings such as billets made by the apparatus and/or method of the invention are provided.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

Figure 1A:
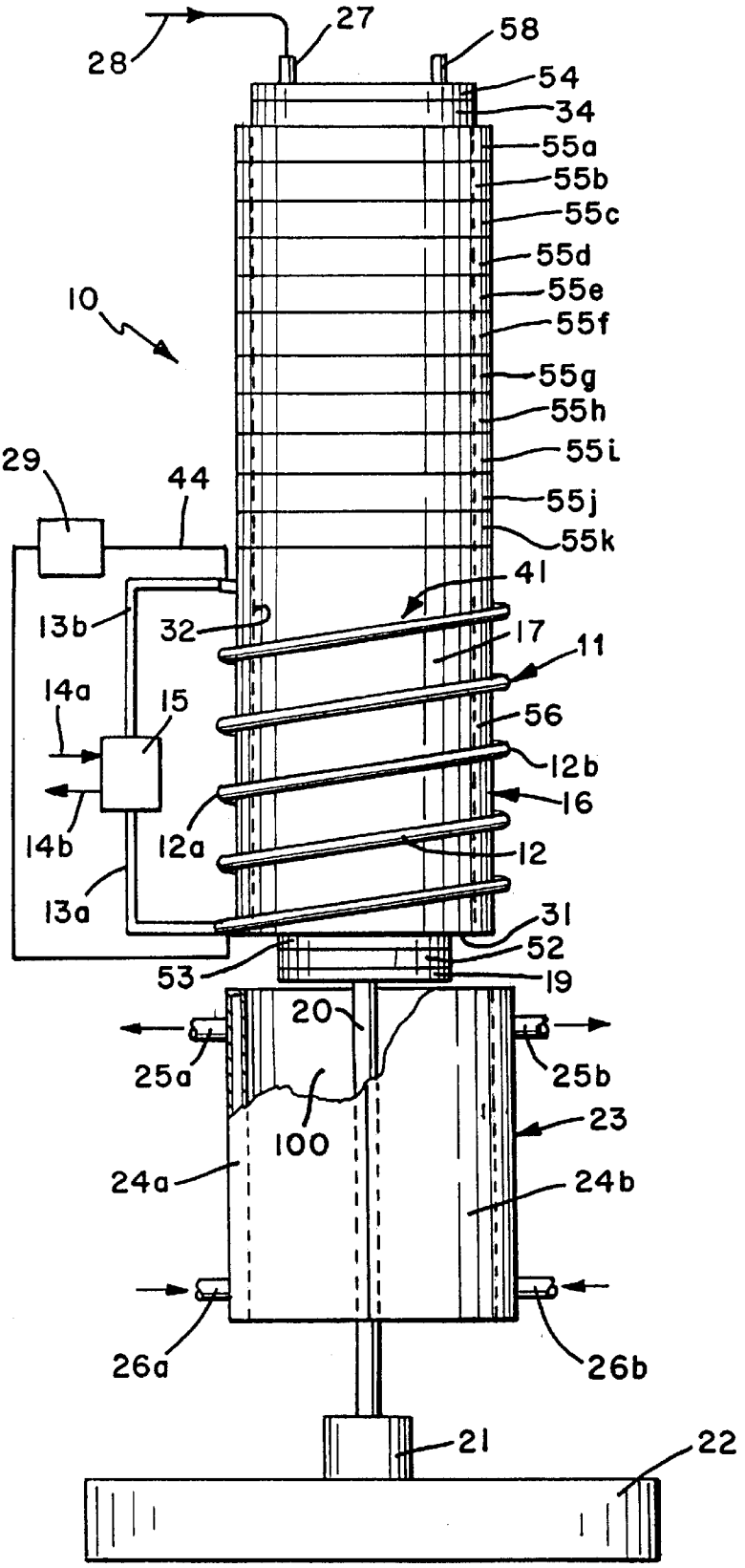
FIGS. 1A–1C are schematic illustrations of a preferred apparatus of the invention at the copper melting stage of the method for making a high purity copper billet, an intermediate cooling stage wherein the container holding the molten metal is being passed downwardly through the cooling jacket to cool the container and the final stage of cooling of the container to form the final billet form, respectively.

In describing the preferred embodiment of the present invention, reference will be made herein to FIGS. 1A–5 of the drawings in which like numerals refer to like features of the invention. Features of the invention are not necessarily shown to scale in the drawings.

Any metal may be cast using the method and apparatus of the invention and the following description will be directed to high purity copper billets for convenience. The use of copper is important in the microelectronics field as a sputter target for the deposition of copper onto electronic component substrates and the term "high purity copper" typically means copper having a purity greater than about 99.999% by weight with the balance including typical impurities. The term also includes copper having a lower purity which may be acceptable for certain applications. The term "oxygen free" copper typically means copper containing less than 10 ppm oxygen, preferably less than 5 ppm oxygen, e.g., 2 ppm. The high purity copper melted to form the casting typically has an oxygen content up to 100–200 ppm or more and the method and apparatus of the invention reduces this oxygen level to oxygen free copper.

The high purity copper castings are usually in the form of cylindrical billets and may be of any size desired for the fabrication process. Typically, the billet will have a diameter of about 2 inch to 12 inch and a height of about 8 inch to 14 inch.

For use in a sputter deposition process, the billet will be formed into disks about 2 inch thick by the electronic component manufacturer or sputter target fabricator. Other shapes and sizes may likewise be cast and cut such as rectangular, square, etc. depending on the use for the casting.

To form the billets or castings, a crucible (or other melting container) is used to both melt the solid copper and to hold the molten copper as it is being solidified to form the casting. The term "crucible" will be used herein to include the generic term "container" and broadly stated is a vessel having an open top, closed bottom and sidewalls and which functions as a container for melting the copper and as a mold for casting the billet. In the preferred method and apparatus of the invention, copper is supplied to the crucible in solid form and melted in the crucible. It is contemplated herein, however, that molten copper or even both molten copper and solid copper may be fed to the crucible. When the copper is melted the molten copper is then solidified according to the cooling step of the invention to form the preferred substantially void and inclusion free casting.

In a preferred embodiment of the invention, the container is a cylindrical crucible open at the top having a closed bottom and sidewall and which is made of purified graphite. A preferred crucible because of its demonstrated effectiveness has an outside diameter of about 8 inches, an outer overall sidewall height of about 28 inches, an inside diameter of about 6 inches, a bottom about 3 inches thick, and inside sidewall height of about 25 inches. The crucible preferably has a removable cover so that air can be minimized in the crucible over the melt surface and preferably so that an inert or reducing atmosphere may be maintained in the crucible and on the surface of the molten copper during preferably both the melting and casting steps of the process. The atmosphere may be an inert gas such $CO_2$, nitrogen, etc. or a reducing gas such as CO because of its demonstrated effectiveness for making an oxygen free copper casting and may be supplied to the crucible by any suitable means such as a conduit (ceramic tube) positioned in a through opening in the crucible cover or crucible sidewall.

The copper may be melted and cast using the method and apparatus of the invention in an air atmosphere (the crucible being uncovered and/or covered and no inert or reducing atmosphere). Typically, the crucible will be covered and an inert gas fed into and maintained in the crucible above the molten copper surface. It has been found that if a reducing gas such as CO is used, the oxygen content of the copper is lowered and the casting substantially oxygen free, e.g., less than 10 ppm oxygen and typically less than 2 ppm oxygen.

Any suitable heating means may be used to melt the copper in the crucible and/or to maintain melted copper molten in the crucible during the casting (cooling) step of the process. It is important however that the heating means not introduce impurities into the copper and for this reason electric furnaces are preferred. A highly preferred furnace is an induction furnace generally comprising an elongated tubular coil forming a helix with an opening between the coil which opening has an inside diameter greater than the outside diameter of the crucible. During operation, the crucible is disposed within the coil opening and using known techniques the coil energized by an electric current thereby forming an electromagnetic field within the opening and heating the crucible and melting the copper. Basically, the electromagnetic field heats the crucible and copper because of their resistance to the field thereby generating heat. Insulation is preferably used in the annular space between the crucible and coil and/or around the outside of the coil to retain the heat in the crucible. In the preferred apparatus where the crucible is positioned on a vertically movable platform and piston it is preferred to use insulation between the platform and crucible and further preferred to use a refractory material sandwiched between the platform and insulation. The refractory material usually in the form of a disk further minimizes heat transfer from the crucible. It is also preferred to place insulation on top of the crucible cover. The insulation is preferably maintained during the melting and casting steps as described hereinbelow.

Figure 1B:
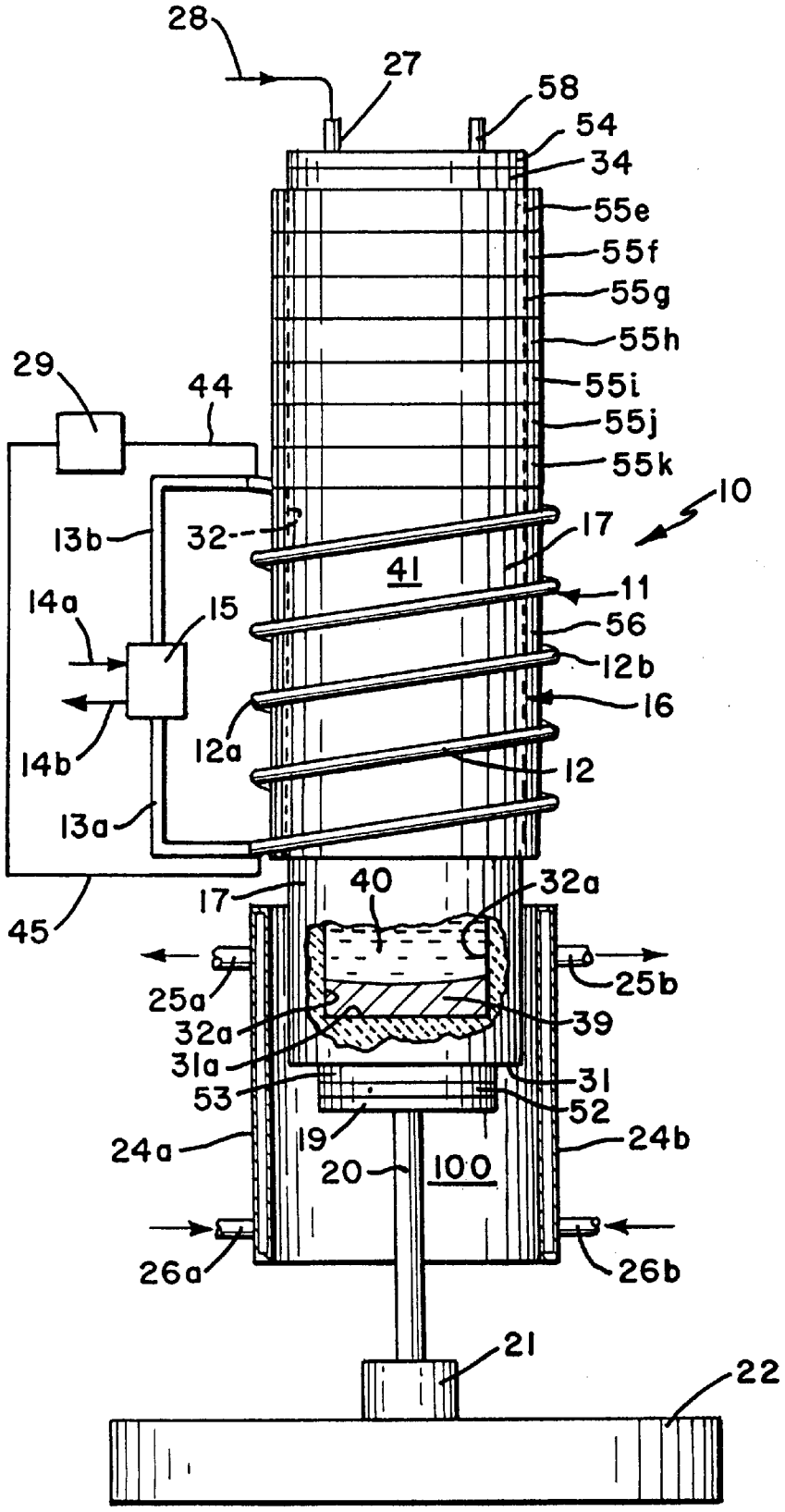
Figure 1C:
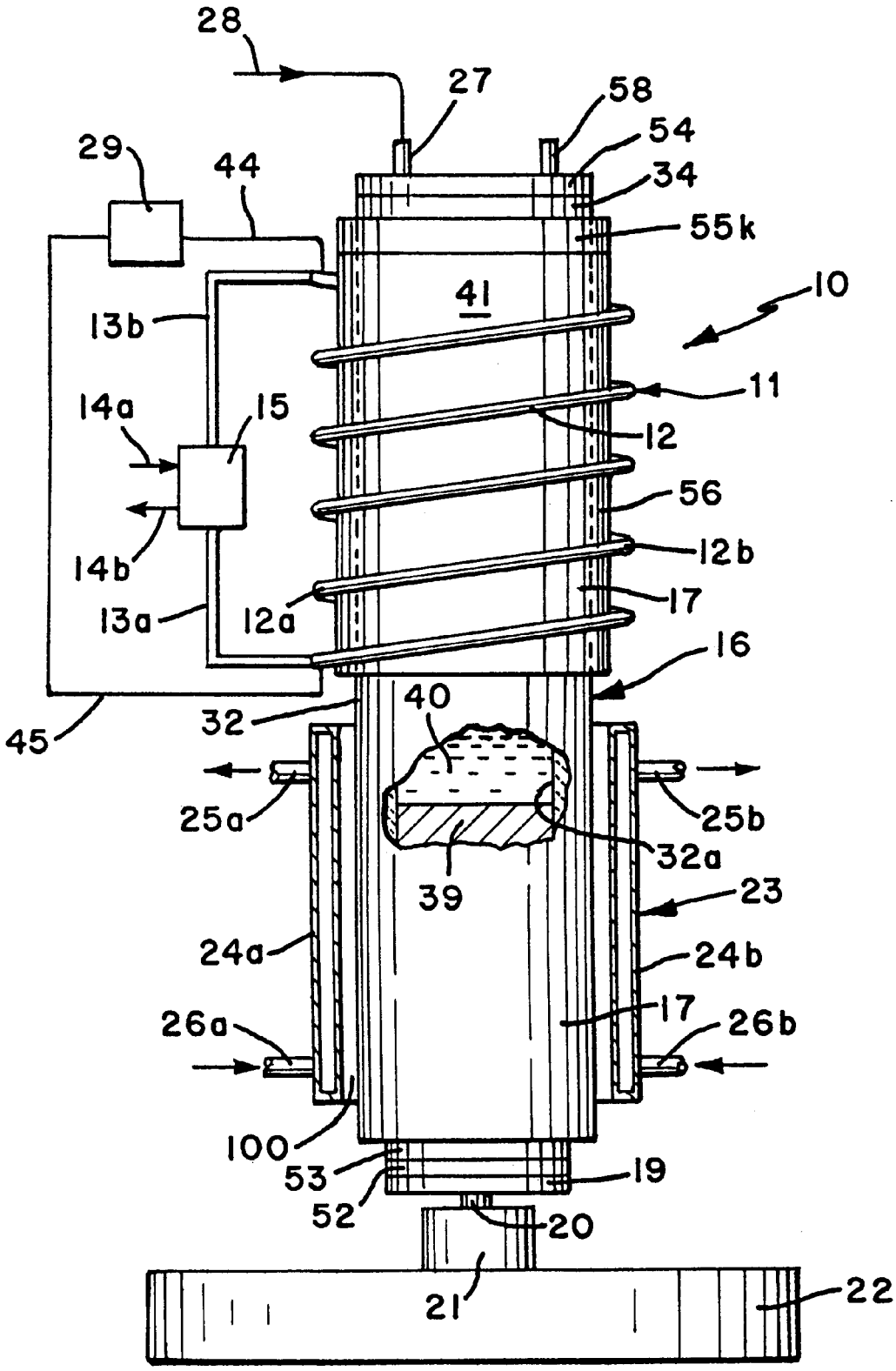

A preferred induction furnace is Model XP-30 made by Ameritherm Inc., Scottsville, N.Y. The preferred furnace includes a heat station for controlling the electric current to the coil and a heat exchanger for cooling the cooling water flowing through the coil. Cooling water is generally passed through the tubular coil to cool the coil which is subjected to heat generated from the crucible. The coil cooling water is in turn cooled by a heat exchanger using a separate cooling water source. The size of the coil and the number of windings of the helix coil will vary depending on the desired height of the crucible and heating requirements. Preferably the height of the induction furnace (coil) is less than the height of the crucible which crucible height facilitates adding solid copper to the crucible and control of the molten copper height in the crucible—which is preferably about the height of the induction furnace coil. The preferred crucible has a height sufficient to extend into both the cooling means and induction coil and most preferably also above the induction coil when used in the preferred apparatus as shown in FIGS. 1A–1C. Maintaining a portion of the crucible completely within the induction coil during the melting and cooling step of the method provides a body of uniform dimension within the coil during.casting providing a uniform electromagnetic field and minimizes superheated zones or casting edge effects.

The cooling means is any cooling device effective to cool the crucible at a controlled cooling rate usually by controlling the flow of cooling water through the cooling device. The cooling device is preferably a water cooled hollow cylindrical jacket whereby cooling water flows through the jacket, the jacket having an opening in which the crucible may be moved downwardly for controlled cooling of the crucible. The crucible is cooled from the bottom upwards wherein copper is first solidified at the bottom of the crucible and which solid copper continues to solidify upwards so that a layer of molten copper is maintained on top of the increasing solidifying and solid copper mass. It has been found that this solidification process provides a substantially void free and inclusion free copper casting. It has also been found preferable to maintain a reduced heat on the upper portion of the crucible which is still in the induction coil while cooling the lower portion of the crucible in the cooling means which method maintains a layer of molten copper above the increasing copper layer solidified by the cooling means.

Referring now to FIG. 1A, a preferred apparatus of the invention is shown generally as 10. The apparatus generally comprises an induction furnace 11, crucible 16, cooling jacket 23 and means to move the crucible in a vertical direction through the induction furnace coil and water jacket opening.

The induction furnace shown generally as 11 comprises an upward spiralling helix tubular coil 12 shown having an outer diameter bounded by turns 12*a* and 12*b*. It will be appreciated that the coil 12 is preferably one continuous coil or may be fabricated in sections and connected at, for example, turns 12*a* and 12*b*, to form the induction furnace 11. The coil 12 is typically hollow so that coil cooling water can pass therethrough and cool the coil during the operation of the furnace. The cooling water in the coil is generally distilled water and is shown exiting the coil in line 13*b*, entering heat exchanger 15, and exiting the heat exchanger in line 13*a* for return to coil structure 12. The heat exchanger 15 cools the coil cooling water by heat exchange with cooling water entering the heat exchange in line 14*a* and exiting the heat exchanger in line 14*b*. The cooling water in lines 14*a* and 14*b* is typically industrial water.

A power source 29 is shown connected to coil 12 by power lines 44 and 45 forming a circuit and is used to supply a current to the coil to form an electromagnetic field in the opening between the coil shown as 41. As is well known in the art, the, induction coil generates a time-varying induction field when excited by an alternating current. The coil induces eddy currents in the metal charge contained in the crucible in a known manner which results in induction heating and melting of the charge. The size of the furnace including coil size, coil height, number of windings, cooling water rate, current level, etc. are all wellknown apparatus and operating parameters which may be calculated for a desired melting and warming operation to maintain copper molten in the upper part of the crucible while the lower portion of the crucible is being cooled. Typical induction furnaces are shown in U.S. Pat. Nos. 5,090,022 and 5,280,496, which patents are hereby incorporated by reference.

Figure 3A:
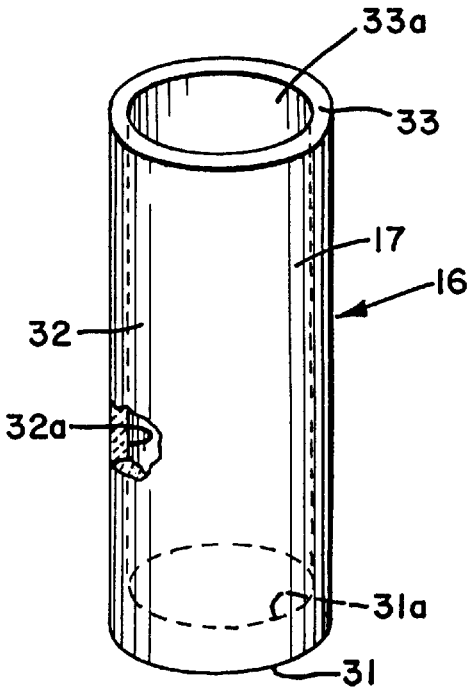
FIG. 3A is a perspective view of a crucible used in the apparatus and method of the invention.

A crucible shown generally as 16 comprises a hollow container 17 having an open top in which a cover 34 is shown inserted and a closed bottom 31. Cover 34 is shown having a ceramic tube 27 inserted therein for supplying an inert gas or reducing gas to the inside of the crucible 16 to form a desired atmosphere over molten metal in the crucible. A thermocouple is shown as 58 and extends preferably into the space above the molten metal. The temperature of the space can be used to monitor and control the temperature of the molten copper in the crucible using known techniques. The crucible 16 as shown in detail in FIG. 3A, is a hollow container 17 with a top opening 33*a*, outer sidewall 32 and a closed bottom 31. The crucible is shown positioned within the coil opening 41 and extending above the top of the coil. The crucible is resting, in sequence, on top of a support 19, refractory disk 52 and insulation 53. The support 19 is connected to a piston rod 20 which is connected to a piston cylinder 21 supported on base 22.

It is preferred that the crucible have an inner height higher than the height of the molten copper to be held therein. This facilitates adding solid copper to the crucible which typically occupies a larger volume than molten copper, avoids spillage and allows better control for an inert or reducing atmosphere over the surface of the molten copper. In the apparatus shown, the crucible extends above the top of the coil.

When an induction or similar type furnace is employed, it is highly preferred that the height of the crucible be sufficient so that a portion of the crucible is maintained within the height of the coil during both the melting and casting steps as described in FIGS. 1A–1C. Thus, as shown in FIGS. 1A–1C a portion of the crucible 17 is at all times within the coil area 41.

It is also a preferred aspect of the invention that insulation 56 be fitted around the crucible body 17 in the annular space between the crucible sidewall 32 and inside of the coil 12. Also, strips of insulation 55*a*–55*b* are preferably employed around the crucible sidewall 32 at the upper end thereof (the portion above the coil). Thus, cover insulation 54, strip insulation 55*a*–55*k*, insulation 56 and bottom insulation 53 (and refractory pedestal 52) provide an insulated crucible body 17 which has been found to be very effective for controlling the cooling of the crucible and molten copper therein to provide void free and inclusion free castings. It will be appreciated that an integral sheet of insulation could be used in place of strips 55*a*–55*k*. However, the strip insulation is easier to use and provides enhanced operating efficiencies.

Referring again to FIG. 1A, a water jacket shown generally as 23 comprises two mating hollow cylindrical semi-circular cooling jackets 24*a* and 24*b* having water outlets 25*a* and 25*b* and water inlets 26*a* and 26*b*. Water flows through the jacket providing a cooling effect within opening 100 of the jacket as is well-known in the art. The water jacket may be made of any suitable material such as metal. It is preferred that the water enter the bottom of the water jacket so that any steam formed in the jacket may easily vent.

In the initial stage of the method for making high purity oxygen free copper castings shown in FIG. 1A, solid copper would be supplied to crucible 16, the cover 34 positioned on top of the crucible and a reducing gas such as CO supplied to crucible 16 by gas source 28 through conduit 27. Piston 20 is activated by cylinder 21 and the bottom 31 of crucible body 17 is positioned at the bottom of the induction furnace. The power 29 would then be energized forming an electromagnetic field within the coil opening 41 which would generate heat in the crucible and in the solid copper held in the crucible thereby melting the copper. Cooling water would cycle through tubular coil 12, lines 13*a* and 13*b* and heat exchanger 15. The induction furnace cooling water would in turn be cooled by water flowing into heat exchanger 15 through line 14*a* and out of heat exchanger 15 through line 14*b*.

When the copper is melted, the crucible body 17 is moved downward into opening 100 of cooling jacket 23 and an intermediate step in the casting process is shown in FIG. 1B. It will be appreciated that in the figures and for demonstration purposes the amount of molten copper in the crucible is about half the inside height of the crucible. This can vary depending on operating and the parameters. Accordingly, the whole length of the crucible need not be contained within the opening 100 of the cooling jacket to solidify all the copper. In FIG. 1B, crucible body 17 is shown moved partly downward into opening 100 of cooling jacket 23. The power which activated the induction furnace 11 in the melting part of the process shown in FIG. 1A is preferably reduced to maintain a lower amount of heat being generated by the furnace which heat still heats crucible 16 and the molten copper but only at the upper end thereof within the coil and at a lower rate sufficient to maintain molten copper above the lower copper layer solidifying due to the cooling of the crucible provided by the cooling jacket. Thermocouple 58 enclosed within an aluminum sheath and inserted into the top of the crucible into the space above the molten copper may be utilized to set the furnace output needed to maintain the copper molten above the solidifying copper. This heat maintains the copper in the upper portion of crucible molten while the lower portion of the crucible is being cooled and the molten copper in the lower portion is being solidified by the cooling jacket 23. The lower portion of crucible body 17 is shown extending partly into opening 100 of cooling jacket 23 thereby cooling the lower portion of the molten copper contained in crucible body 17.

As the crucible body 17 is being lowered, strips 55 of insulation are intermittently being removed (peeled) from the crucible. Thus, in the crucible position from FIG. 1A to 1B, strips of insulation 55*a*–55*d* have been removed. This still leaves strips 55*e*–55*k* covering the upper portion of the crucible above coil 12. Insulation 56 and bottom insulation 53 are still in place.

A cut-away view of crucible body 17 shows a solid copper 39 layer being formed at the inside bottom 31*a* of crucible body 17 and upwards along inside sidewall 32*a*. Sidewall 32*a* of the crucible defines the outside diameter of the formed casting. The solid copper 39 is shown having a layer of molten copper 40 on top of the solid copper layer. As the crucible is moved downward, the height of the solid copper layer will increase and the amount of molten copper in the crucible will decrease. As can also be seen in FIG. 1B, piston 20 has been retracted partly into cylinder 21 thereby positioning the upper portion of crucible body 17 within opening 41 of induction furnace 11 and the lower portion within opening 100 of cooling jacket 23.

It will be appreciated that in the preferred aspect of the invention that the crucible 16 is continually or intermittently being moved downwardly into cooling jacket 23 and out of the opening 41 of induction furnace 11 by retracting piston 20. It is an important feature of the invention that the downward rate and/or rate of cooling water supplied to the water jacket be specially controlled to provide an upward cooling of the crucible so as to maintain a layer of molten copper on top of solidified copper in the crucible. It has been found as shown in the examples that a downward crucible rate up to about 1 inch/minute, preferably about 0.1 to 0.2 inch/minute provides void free and inclusion free billets when using the apparatus of the invention.

It is preferred that a portion of the crucible be within the height of the coil during the method of the invention and referring now to FIG. 1C, the lower portion of the crucible body 17 which is about the height of the copper billet to be formed, is shown removed from opening 41 in induction furnace 11 and enclosed in opening 100 of cooling jacket 23. A cut-away view of crucible 16 shows a layer of solid copper 39 having a layer of molten copper 40 on top thereof. There is only a small amount of molten copper remaining in the crucible at this time, which will solidify forming the substantially void and inclusion free casting. Piston 20 is shown fully retracted into cylinder 21. At this point, the power source 29 would be turned off and the furnace deactivated. After completion of the cooling in crucible 16, a billet is formed as shown in FIG. 2.

The upper portion of the crucible body 17 is shown within coil area 41 and extending above the coil and only one strip of insulation 55*k* remains along with insulation 56, bottom insulation 53 and cover insulation 54.

Figure 2:
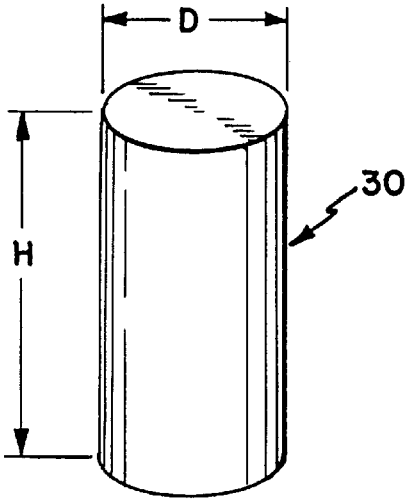
FIG. 2 is a perspective view of a billet formed using the method and apparatus of the invention.

A billet is shown generally in FIG. 2 as 30 and has a diameter D and a height H. The diameter D is the inside diameter of the crucible as shown in FIG. 3A which crucible 16 comprises a hollow top open ended container 17 having an outer sidewall 32 and an inside sidewall shown as 32*a*. The closed bottom of the crucible 16 is shown as 31 and has an inside bottom 31*a*. The crucible 16 has an upper surface 33 and the outer sidewall 32 and inside sidewall 32*a* defines a cylindrical opening 33*a*. The cylindrical opening 33*a* forms the outside diameter of the billet which would be formed as shown in FIG. 2. The height of the billet will depend on the amount of copper melted in crucible 16.

Figure 3B:
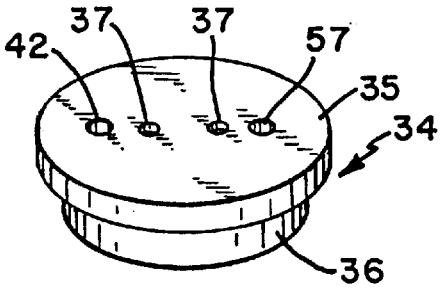
FIG. 3B is a perspective view of a cover used to close the crucible shown in FIG. 3A.

FIG. 3B shows a cover used to enclose opening 33*a* of crucible 16. The cover is shown generally as 34 and comprises an upper portion 35 which overlays crucible upper surface 33 and a lipped lower portion 36 which is sized to fit into opening 33*a* of crucible body 17. Cover 34 is also shown having indents 37 used for placing or removing the cover using for example tongs or other mechanical means. Through opening 42 therein would be used in conjunction with a ceramic or other refractory tube 27 for providing an inert or reducing atmosphere to the crucible 16 as shown in FIGS. 1A–1C. Other opening 57 could be used for a thermocouple, etc.

Figure 4:
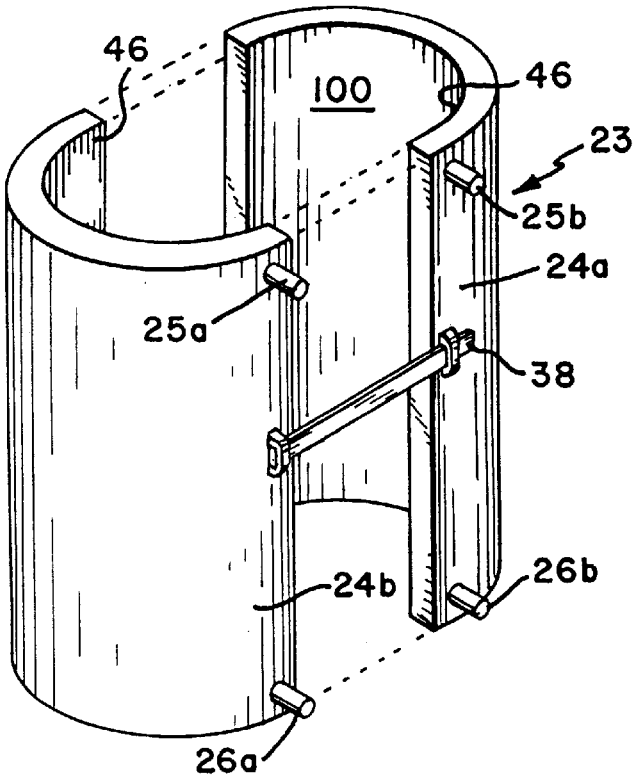
FIG. 4 is a perspective view of a water jacket used in the apparatus and method of the invention.

FIG. 4 shows an exploded view of a water jacket 23 used in the method and apparatus of the invention. The water jacket 23 is shown in two mating sections, 24*a* and 24*b*. Each section has water outlets 25*a* and 25*b* and water inlets 26*a* and 26*b*. The water jacket in use would be mated together by a locking mechanism shown generally as 38. The opening 100 formed by water jacket 23 is sized to accommodate crucible 16. Generally, it is preferred to have a minimum clearance between the outer sidewall 32 of crucible 16 and the inside wall 46 of water jacket 23 for enhanced heat transfer and controlled cooling. The clearance may vary widely and is a function of cooling water rate in the cooling jacket, rate of downward motion of the crucible, thickness of the crucible, material of construction of the jacket, etc. An annular clearance up to about 0.25 inch has provided excellent operating results.

EXAMPLES

A number of copper billets were made using the following apparatus and method. Ameritherm Induction Furnace Model XP-30 was employed which uses an Ameritherm |83 Remote Heat Station and an Ameritherm System II water to water heat exchanger. Distilled water was cycled through the coil and heat exchanger at a rate of about 5 gpm. Cooling water was passed through the heat exchanger at a rate of about 5–10 gpm. The furnace has a coil inside diameter of about 11 inch and a coil height of about 10.75 inch. A purified graphite crucible was used having an 8 inch outside diameter, 6 inch inside diameter, 28 inch overall height and 25 inch inside height (bottom about 3 inch thick). A sufficient amount of solid high purity copper was added (about 85 pounds) and melted to make a billet of about 6 inch in diameter and 10 inch high. A water jacket made of MILd steel was used comprising two (2) semi-circular mating halves, which provided an inside diameter of about 8 inch and outside diameter of about 9 inch. Cooling water was passed through each half at a rate of about 5–10 gpm.

A vertically moveable support was used to support and vertically move the crucible. A refractory disk was placed on the support, followed by insulation and the crucible. The induction furnace was positioned above the cooling jacket and the support positioned below the cooling jacket. When ready to be used, the support was raised to move the lower portion of the crucible within the induction coil opening. The lower portion represents approximately the height of the copper in the crucible when molten (about 10 inches). The induction coil is connected to the heat station and the crucible wrapped with fiber wool insulation between the inside of the coil and the outside of the crucible. The cover of the crucible was also insulated with fiber wool insulation. Strips of insulation as shown in FIGS. 1A–1C were used to insulate the portion of the crucible above the coil. The cooling water lines were connected to the water jacket, induction coil and heat exchanger for the induction coil.

Carbon monoxide was supplied to the crucible to maintain a CO reducing atmosphere over the copper in the crucible. The furnace was activated by supplying an AC current at about 10 kw and the copper charge in the crucible melted. The crucible was then slowly lowered so that it would pass downward through the induction coil opening and into the water jacket opening. During downward movement of the crucible, the energy supplied to the induction furnace was reduced in steps to about 4 kw. Strips of insulation were removed as the crucible was lowered as shown in FIGS. 1A–1C. During the downward movement and cooling of the crucible and forming of the billet, the CO atmosphere gas was maintained in the crucible. The copper was molten at the upper portion of the crucible during the casting step. The gas was also maintained for 24 hours after the copper was solidified. The billet was then removed from the crucible.

In one run, a total of 82.4 pounds of high purity copper was added to the crucible and melted. Casting was commenced by lowering the crucible downwardly into the water jacket opening at a rate of about 0.1–0.2 inch per minute for a time of about 100 minutes.

The copper billet was formed without any substantial voids or inclusions. The ends were cut off yielding a 6 inch diameter×8.5 inch long billet. The billet was pickled with nitric acid to remove surface contaminants. The billet was oxygen free and commercially acceptable for use in the manufacture of a sputtering target for use in a sputter deposition process The subject invention has been described in detail with regard to the use of a crucible or other container in which copper is melted and maintained molten and then the crucible cooled to solidify the copper and form a billet. The preferred method as described hereinabove is to use a crucible which is heated within a coil of an induction furnace and then to cool the crucible from the bottom of the crucible upwards to solidify the copper at the bottom of the crucible which solid layer increases upward while maintaining molten copper on the surface of the solid and solidifying copper layer. A water jacket was preferably employed to cool the crucible by lowering the crucible through the jacket opening at a defined rate to effect the desired cooling of the crucible and molten copper.

It is also contemplated herein that other methods of heating a crucible or mold and cooling of the crucible or mold may be employed to provide such a billet having no significant voids or inclusions. Induction furnaces with cooled crucibles are well known in the art as shown in U.S. Pat. Nos. 4,873,698; 5,090,022; and 5,280,496, which patents are hereby incorporated by reference. Cold crucible induction melting is widely used for melting reactive metals having high melting points such as titanium. Such high melting point reactive metals cannot be melted successfully in refractory crucibles since the metals when molten react with the refractory crucibles causing the melt to become contaminated. The solution to the contamination problem has been to cool the crucible to avoid temperatures high enough for reactions to occur between the crucible and the contained metal. This solution relies on the use of what is commonly termed "cold crucibles" wherein the crucible usually made of metal is cooled by circulating water through cooling passages inside the crucible walls. The circulating water holds the temperature of the crucible below temperatures at which reaction between the crucible and the metal being melted would occur. Typically, such crucibles are made from a plurality of vertical metal segments, electrically isolated from each other, in which cooling coils are vertically inserted along the vertical axis of the crucible. The water is flowed through the coils during melting of the charge and keeps the crucible at the desired temperature. The crucible is maintained within the induction coil and once the charge is melted the metal is typically poured from the crucible into a mold.

Figure 5:
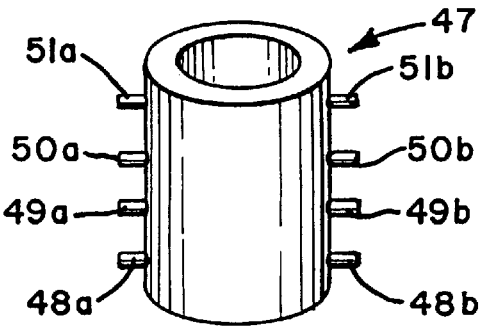
FIG. 5 is a perspective view of a crucible having horizontal cooling tubes.

It is contemplated herein that such a cold crucible could be used in the subject apparatus and method by employing a crucible having cooling coils which are horizontal to the vertical axis of the crucible. With such a cooling coil design the cooling can be controlled from the bottom of the crucible upwards to provide the desired cooling of the crucible and solidifying of the melt as is obtained by passing the crucible downward through a cooling jacket as described hereinabove. In operation, the cold crucible would be inserted within the induction coil and the charge melted. After the charge is melted the energy would be deactivated and the cooling coils activated from the bottom up in a controlled upward cooling sequence. Such a process would cool the crucible from the bottom up and provide the desired cooling to provide a substantially void and inclusion free billet. Another crucible design is shown in FIG. 5. The crucible is similar to the crucible shown in FIG. 3A except that horizontal cooling coils are built into the wall of the crucible. Water inlets 48*a*, 49*a*, 50*a* and 51*a* provide cooling water to the crucible which exits at outlets 48*b*, 49*b*, 50*b* and 51*b*, respectively. In operation, water would first be supplied to inlet 48*a* and removed at 48*b*. This will cool the bottom of the crucible. Water will then be added at 49*a* and removed at 49*b*. This will provide an upward cooling profile in the crucible and form the desired void free and inclusion free billet. Any number of water inlets and outlets can be used depending on the cooling profile desired.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for making high purity copper castings from high purity copper which castings are substantially void free and inclusion free comprising the steps of:

providing an open top container having a closed bottom and sidewalls for melting and holding copper therein;

supplying high purity copper to the container;

melting the copper in the container using a coil induction furnace wherein the coil forms a vertical opening therebetween in which the container is positioned and forming an annular space between the container sidewalls and the coil and wherein the copper in the container is melted by energizing the furnace with an electric current;

providing insulation in the annular space;

providing a cooler having cooled sidewalls and a vertical opening therebetween, the cooler being configured to accommodate and receive the container in the vertical opening in a heat transfer relationship so that heat is transferred from the container to the cooler;

positioning the bottom of the container at the top of the cooler opening and passing the container downwardly through the cooler opening at a controlled downward rate and/or a controlled cooler sidewall cooling rate wherein both solidified copper and molten copper are present in the container at the same time with the copper solidifying from the bottom of the container upwards toward the top of the container and continuing to solidify on top of the solidified copper so that a layer of molten copper is maintained on top of the solidified and solidifying copper until the copper is solidified and a casting is formed.

2. The method of claim 1 wherein the open top of the container is covered and an inert gas provided in the covered container.

3. The method of claim 1 wherein the open top of the container is covered and a reducing gas provided in the covered container.

4. The method of claim 3 wherein a water cooled jacket is used to cool the container.

5. The method of claim 4 wherein the container is passed downwardly through an opening in the water jacket.

6. The method of claim 5 wherein sufficient heat is generated in the furnace during the downward movement of the container into the opening in the water jacket to maintain the copper in the upper portion of the container molten.

7. An apparatus for making high purity copper castings from high purity copper which castings are substantially void free and inclusion free comprising:

an open top container having a closed bottom and sidewalls for melting and holding molten copper therein;

means for supplying high purity copper to the container;

a coil induction furnace wherein the coil forms a vertical opening therebetween in which the container is positioned and forming an annular space between the container sidewalls and the coil and the copper is melted by energizing the furnace with an electric current;

insulation means positioned in the annular space; and means for cooling the container under cooling conditions wherein the container is cooled from the bottom upwards toward the top of the container so that both solidified copper and molten copper are present in the container at the same time with the copper solidifying from the bottom of the container upwards and continuing to solidify on top of the solidified copper so that a layer of molten copper is maintained on top of the solidified and solidifying copper until the copper is solidified and a casting is formed.

8. The apparatus of claim 7 including means for covering the open end of the container.

9. The apparatus of claim 8 including means for maintaining the copper under an inert atmosphere.

10. The apparatus of claim 8 including means for maintaining the copper under a reducing atmosphere.

11. The apparatus of claim 7 wherein the container is a purified graphite crucible.

12. The apparatus of claim 11 wherein the cooling means is a water jacket.

13. The apparatus of claim 12 wherein the induction furnace and crucible are positioned over the water jacket and the crucible containing the molten copper passed downwardly through the cooling jacket to cool the crucible.

* * * * *